US011763737B2

(12) United States Patent
Li et al.

(10) Patent No.: US 11,763,737 B2
(45) Date of Patent: Sep. 19, 2023

(54) MICRO-LED DISPLAY PANEL AND DISPLAY DEVICE

(71) Applicants: Chongqing HKC Optoelectronics Technology Co., Ltd, Chongqing (CN); HKC Corporation Limited, Guangdong (CN)

(72) Inventors: Zeyao Li, Chongqing (CN); Haijiang Yuan, Chongqing (CN)

(73) Assignees: CHONGQING HKC OPTOELECTRONICS TECHNOLOGY CO., LTD, Chongqing (CN); HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 18/081,937

(22) Filed: Dec. 15, 2022

(65) Prior Publication Data

US 2023/0196990 A1 Jun. 22, 2023

(30) Foreign Application Priority Data

Dec. 17, 2021 (CN) ..... 202111556534.9

(51) Int. Cl.
*G09G 3/32* (2016.01)

(52) U.S. Cl.
CPC ..... *G09G 3/32* (2013.01); *G09G 2310/0264* (2013.01); *G09G 2320/0233* (2013.01)

(58) Field of Classification Search
CPC ..... G09G 3/32; G09G 2310/0264; G09G 2320/0233; G09G 2300/0426; G09G 2320/0223; G09G 2330/02; G09F 9/33
See application file for complete search history.

(56) References Cited

U.S. PATENT DOCUMENTS

2020/0020273 A1* 1/2020 Hong ..... H10K 77/111
2020/0327855 A1* 10/2020 Lin ..... G09G 3/3233
2021/0327325 A1* 10/2021 Peng ..... G09G 3/006
2021/0376038 A1* 12/2021 Won ..... H10K 77/111

* cited by examiner

*Primary Examiner* — Andrew Sasinowski
(74) *Attorney, Agent, or Firm* — Scully, Scott, Murphy & Presser, P.C.

(57) ABSTRACT

A Micro-LED display panel and a display device are provided. The display panel has a display region provided with pixel units, and includes a first voltage-main-line, a second voltage-main-line, a first input-unit, and a second input-unit. The first voltage-main-line and the second voltage-main-line each surround the display region. A first voltage-access-end of each pixel unit is electrically coupled with the first voltage-main-line nearby. A second voltage-access-end of each pixel unit is electrically coupled with the second voltage-main-line nearby. The first input-unit and the second input-unit are respectively located on a periphery of opposite sides of the display region in a first direction. The first input-unit and the second input-unit each are electrically coupled with the first voltage-main-line nearby, to supply a first voltage to the first voltage-main-line. The first input-unit is electrically coupled with the second voltage-main-line nearby, to supply a second voltage to the second voltage-main-line.

20 Claims, 10 Drawing Sheets

MICRO-LED DISPLAY PANEL AND DISPLAY DEVICE

CROSS-REFERENCE TO RELATED APPLICATIONS

This application claims priority under 35 U.S.C. § 119(a) to Chinese Patent Application No. 202111556534.9, filed Dec. 17, 2021, the entire disclosure of which is incorporated herein by reference.

TECHNICAL FIELD

This application relates to the field of display panels, and particularly to a Micro Light Emitting Diode (Micro-LED) display panel and a display device.

BACKGROUND

Micro Light Emitting Diode (Micro-LED) display technology is an ultra-high-definition display technology realized by forming an LED array of micron-scale pitches through miniaturizing and integrating of traditional LEDs. Micro-LED has a characteristic of self-lighting. Compared to Organic Light Emitting Diode (OLED) and Liquid Crystal Display (LCD), color debugging for the Micro-LED is easier and more accurate, the Micro-LED has a longer lifetime and higher brightness, and is thinner and more power-saving, and therefore, the Micro-LED display technology is a new generation revolutionary display technology with great potential.

The Micro-LED is a current-driven display, and a VDD power-supply and a VSS power-supply in a drive circuit can provide the LED with a drive current required by the LED to emit lights. However, since a VDD trace and a VSS trace each have impedance, if the drive current for the Micro-LED is relatively large, a large voltage variation occurs when the drive current flows through the VDD trace and the VSS trace in a panel (e.g., a voltage drop (IR Drop) occurs when the drive current flows through the VDD trace, and a voltage rise occurs when the drive current flows through the VSS trace). Such voltage variation in turn will seriously affect a current flowing through the LED, and further affect a display effect. In an existing Micro-LED display panel, the VDD power-supply and the VSS power-supply are generally coupled into the display panel at two sides of the top of the display panel. Obviously, a length of a trace between the VDD power-supply/VSS power-supply and a display region at the two sides of the top of the display panel is relatively short, and the voltage variation is relatively small; a length of a trace between the VDD power-supply/VSS power-supply and a display region in the bottom middle of the display panel is relatively long, and the voltage variation is relatively large. As a result, when a user uses the display panel, a significant brightness difference between the top of the display panel and the bottom middle of the display panel can be perceived by the user, resulting in a poor experience.

SUMMARY

The disclosure provides a Micro Light Emitting Diode (Micro-LED) display panel. The Micro-LED display panel has a display region, and includes a first voltage-main-line, a first input-unit, and a second input-unit. The display region is provided with multiple pixel units. The multiple pixel units each include a first voltage-access-end and a second voltage-access-end. The first voltage-main-line and the second voltage-main-line each surround the display region. A first voltage-access-end of each of the multiple pixel units is electrically coupled with the first voltage-main-line nearby. A second voltage-access-end of each of the multiple pixel units is electrically coupled with the second voltage-main-line nearby. The first input-unit and the second input-unit are respectively located on a periphery of opposite sides of the display region in a first direction. The first input-unit is electrically coupled with the first voltage-main-line nearby and electrically coupled with the second voltage-main-line nearby, to supply a first voltage to the first voltage-main-line and supply a second voltage to the second voltage-main-line. The second input-unit is electrically coupled with the first voltage-main-line nearby, to supply the first voltage to the first voltage-main-line.

The disclosure further provides a display device. The display device includes a housing and the above Micro-LED display panel. The housing defines a receiving cavity. The Micro-LED display panel is received in the receiving cavity.

Figure 1:
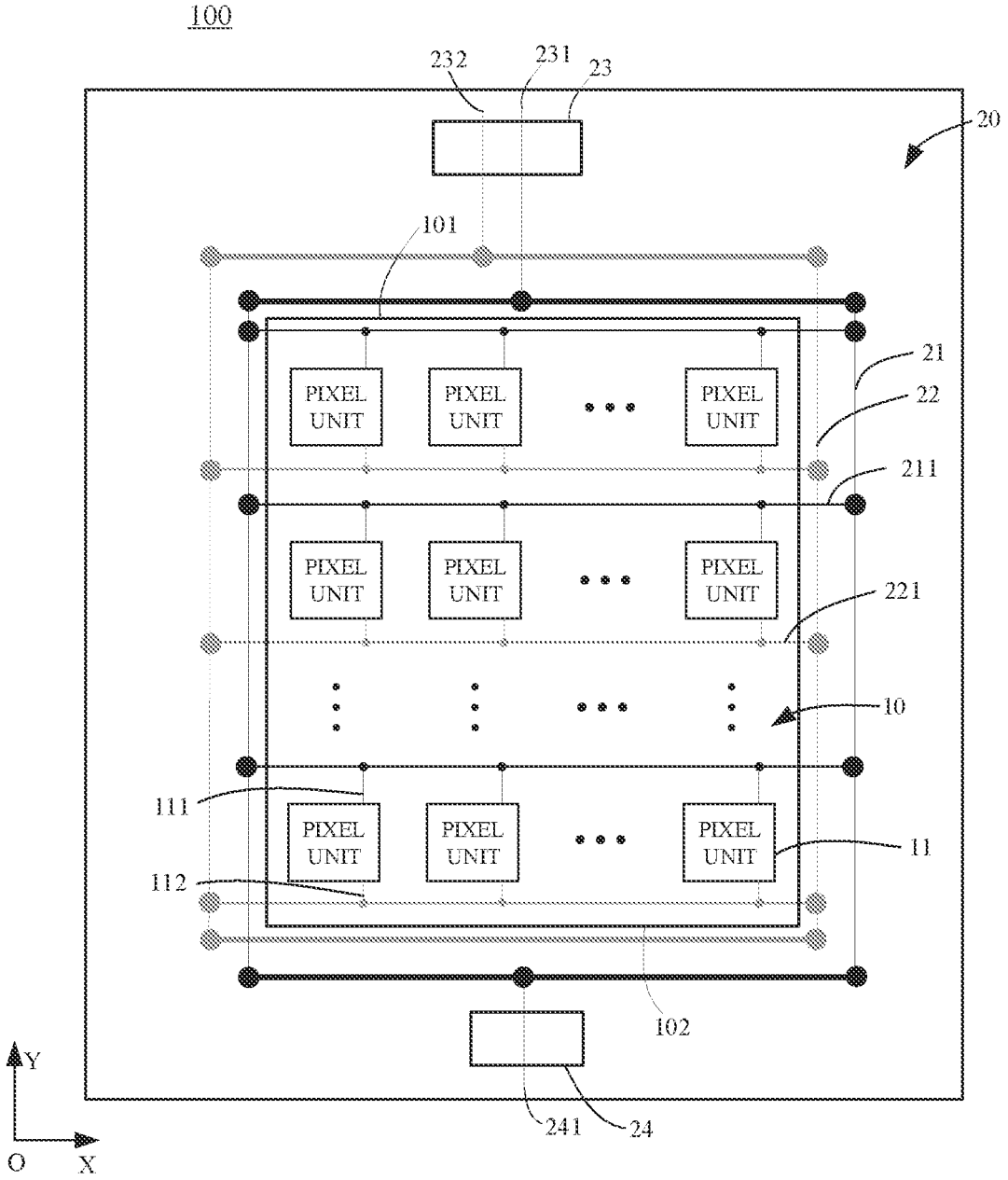
FIG. 1 is a schematic structural diagram illustrating a Micro Light Emitting Diode (Micro-LED) display panel provided in implementations of the disclosure.

The disclosure will be further depicted below with reference to specific implementations and accompanying drawings.

DETAILED DESCRIPTION

Hereinafter, technical solutions of implementations of the disclosure will be depicted in a clear and comprehensive manner with reference to accompanying drawings intended for these implementations. Apparently, implementations described below merely illustrate some implementations, rather than all implementations, of the disclosure. All other implementations obtained by those of ordinary skill in the art based on the implementations of the disclosure without creative efforts shall fall within the protection scope of the disclosure.

In description of the disclosure, it should be noted that, orientations or positional relationships indicated by the terms "upper", "lower", "left", "right", and the like are based on orientations or positional relationships illustrated in the accompanying drawings, and are only for convenience of describing the disclosure and simplifying the description, rather than indicating or implying that the referred device or element must have a specific orientation, be constructed and operated in a specific orientation, and therefore should not be construed as a limitation of the disclosure. In addition, the terms "first", "second", and the like are used for descriptive only and should not be construed to indicate or imply relative importance.

The disclosure provides a Micro Light Emitting Diode (Micro-LED) display panel and a display device, which aims to solve a problem of a significant brightness difference between the top of an existing Micro-LED display panel and the bottom middle of the existing Micro-LED display panel.

The disclosure provides a Micro-LED display panel. The Micro-LED display panel has a display region, and includes a first voltage-main-line, a second voltage-main-line, a first input-unit, and a second input-unit. The display region is provided with multiple pixel units. The multiple pixel units each include a first voltage-access-end and a second voltage-access-end. The first voltage-main-line and the second voltage-main-line each surround the display region. A first voltage-access-end of each of the multiple pixel units is electrically coupled with the first voltage-main-line nearby. A second voltage-access-end of each of the multiple pixel units is electrically coupled with the second voltage-main-line nearby. The first input-unit and the second input-unit are respectively located on a periphery of opposite sides of the display region in a first direction. The first input-unit is electrically coupled with the first voltage-main-line nearby and electrically coupled with the second voltage-main-line nearby, to supply a first voltage to the first voltage-main-line and supply a second voltage to the second voltage-main-line. The second input-unit is electrically coupled with the first voltage-main-line nearby, to supply the first voltage to the first voltage-main-line.

According to the display panel of the disclosure, by providing the first voltage-main-line and the second voltage-main-line around the periphery of the display region and providing the first input-unit and the second input-unit on a periphery of opposite sides (i.e., a first side and a second side) of the display panel in the first direction, the first voltage can be supplied to the first voltage-main-line respectively through the first input-unit and the second input-unit, so that the first voltage can at least be transmitted to each pixel unit from the opposite sides of the display region, which can significantly reduce a difference between first voltages received by pixel units on the opposite sides of the display region, thereby improving uniformity of brightness of the display panel and a user experience.

Optionally, the first input-unit includes at least one set of power input ports. Each set of power input ports includes a first voltage-input-port and a second voltage-input-port. The first voltage-input-port is electrically coupled with the first voltage-main-line nearby via a lead. The second voltage-input-port is electrically coupled with the second voltage-main-line nearby via a lead. As such, the first voltage-input-port and the second voltage-input-port can share the input-unit, and the circuit is simpler.

Optionally, the first input-unit is located on a periphery of a first side of the display region. The first input-unit includes a first set of power input ports and a second set of power input ports. The first set of power input ports includes a first voltage-input-port and a second voltage-input-port, where the first voltage-input-port in the first set is electrically coupled with a first end of the first voltage-main-line on the first side of the display region, and the second voltage-input-port in the first set is electrically coupled with a first end of the second voltage-main-line on the first side of the display region. The second set of power input ports includes a first voltage-input-port and a second voltage-input-port, where the first voltage-input-port in the second set is electrically coupled with a second end of the first voltage-main-line on the first side of the display region, and the second voltage-input-port in the second set is electrically coupled with a second end of the second voltage-main-line on the first side of the display region. The first end of the first voltage-main-line is opposite to the second end of the first voltage-main-line, and the first end of the second voltage-main-line is opposite to the second end of the second voltage-main-line. Two opposite ends of the first voltage-main-line on the first side of the display region each are electrically coupled with a corresponding first voltage-input-port, so that voltage variation of the first voltage can be reduced during transmission of the first voltage.

Optionally, the second input-unit includes at least one set of power input ports. Each set of power input ports at least includes a first voltage-input-port, where the first voltage-input-port is electrically coupled with the first voltage-main-line nearby via a lead.

Optionally, the display panel further includes a third input-unit and a fourth input-unit. The third input-unit and the fourth input-unit are respectively located on a periphery of opposite sides of the display region in a second direction. The third input-unit is electrically coupled with the first voltage-main-line nearby and the fourth input-unit is electrically coupled with the first voltage-main-line nearby, to supply the first voltage to the first voltage-main-line. The second direction is at a preset angle from the first direction. As such, the first voltage is supplied to the first voltage-main-line from four sides (i.e., a first side, a second side, a third side, and a fourth side) respectively, which can further reduce the voltage variation of the first voltage during the transmission of the first voltage.

Optionally, the third input-unit and the fourth input-unit each include at least one set of power input ports. Each set of power input ports at least includes a first voltage-input-port, where the first voltage-input-port is electrically coupled with the first voltage-main-line nearby via a lead.

Optionally, the display panel further has a non-display region surrounding the display region. The first voltage-main-line, the second voltage-main-line, the first input-unit, the second input-unit, the third input-unit, and the fourth input-unit are disposed in the non-display region. As such, influence of the trace on a display effect of the display panel can be avoided.

Optionally, the display panel further includes multiple first connection lines arranged in parallel. The first connection lines each extend along a second direction. Two ends of each of the first connection lines are electrically coupled with the first voltage-main-line. A first voltage-access-end of each of the pixel units is coupled with a first connection line nearby, to be electrically coupled with the first voltage-main-line via the first connection line to receive the first voltage. The second direction is at a preset angle from the first direction. As such, consistency of first voltages received by pixel units in a same row can be improved, thereby improving uniformity of brightness of the pixel units in the same row.

Optionally, the display panel further includes multiple second connection lines arranged in parallel. The second connection lines each extend along the first direction. Two ends of each of the second connection lines are electrically coupled with the first voltage-main-line. The multiple second connection lines and the multiple first connection lines cooperatively form a power grid including multiple grid units. A first voltage-access-end of each of the pixel units is electrically coupled with a corresponding grid unit, to be electrically coupled with the first voltage-main-line to receive the first voltage.

Optionally, the first voltage-main-line is a drive-voltage line, the second voltage-main-line is a reference-voltage line, the first voltage is a drive voltage, and the second voltage is a reference voltage. Alternatively, the first voltage-main-line is a reference-voltage line, the second voltage-main-line is a drive-voltage line, the first voltage is a reference voltage, and the second voltage is a drive voltage. Such a design can be applied to different types of display panels, thereby enhancing applicability.

The disclosure further provides a display device. The display device includes a housing and the above Micro-LED display panel. The housing defines a receiving cavity. The Micro-LED display panel is received in the receiving cavity. The display device adopts the above display panel, which can improve uniformity of brightness of the display panel and a user experience.

Referring to FIG. 1, FIG. 1 illustrates a Micro-LED display panel provided in implementations of the disclosure. A display panel 100 has a display region 10 and a non-display region 20. The non-display region 20 is located around the display region 10. The display region 10 is provided with multiple pixel units 11. Exemplarily, the multiple pixel units 11 are arranged in an array in the display region 10. Each of the pixel units 11 includes a light-emitting element and a pixel drive circuit PDC, where the pixel drive circuit PDC is configured to drive the light-emitting element to emit lights. A light-emitting element of an existing display panel 100 is generally a current device, and the existing display panel 100 adopts a drive circuit including transistors to drive the light-emitting element to emit lights. In order to meet different performance requirements of the display panel, the pixel drive circuit PDC can be designed to have different circuit structures. Exemplarily, the pixel drive circuit PDC may include a 2T1C pixel drive circuit, a 3T1C pixel drive circuit, a 4T1C pixel drive circuit, a 4T2C pixel drive circuit, etc., where the 2T1C pixel drive circuit (including two transistors and one capacitor) is the simplest pixel drive circuit.

Figure 2:
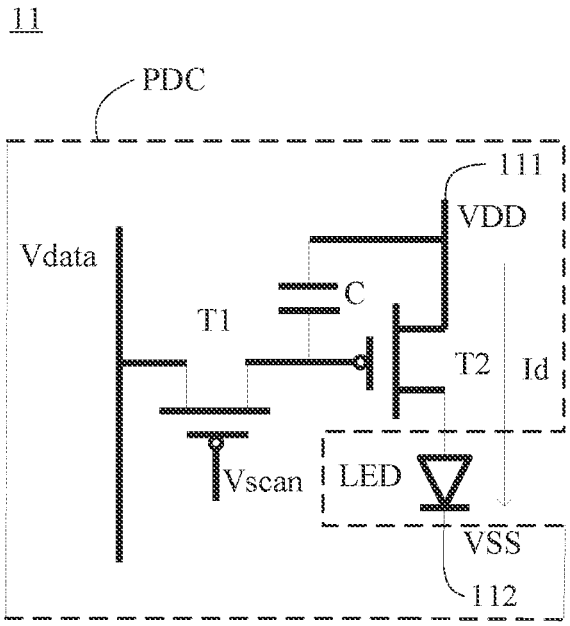
FIG. 2 is a schematic diagram illustrating a circuit structure of a pixel drive circuit provided in implementations of the disclosure.

FIG. 2 is a schematic diagram illustrating a circuit structure of a 2T1C pixel drive circuit provided in implementations of the disclosure. As illustrated in FIG. 2, a pixel unit 11 includes a light-emitting element LED and a pixel drive circuit PDC. The pixel drive circuit PDC includes a switch transistor T1, a drive transistor T2, a storage capacitor C, a first voltage-access-end 111, and a second voltage-access-end 112. In the implementations illustrated in FIG. 2, the drive transistor T2 is a P-type transistor. The first voltage-access-end 111 is electrically coupled with a source of the drive transistor T2, to supply a drive voltage VDD (a high voltage) through the first voltage-access-end 111. A drain of the drive transistor T2 is electrically coupled with an anode of the light-emitting element LED, and a cathode of the light-emitting element LED is electrically coupled with the second voltage-access-end 112, to supply a reference voltage VSS (a low voltage) through the second voltage-access-end 112.

The switch transistor T1 is configured to selectively supply a data voltage Vdata to a gate of the drive transistor T2 according to a scan signal Scan. If the scan signal Scan is an on signal, the data voltage Vdata is supplied to the gate of the drive transistor T2 through the switch transistor T1 switched-on, and at the same time, the storage capacitor C is charged until a voltage of the storage capacitor C is equal to the data voltage Vdata. If the scan signal Scan is an off signal, the switch transistor T1 is switched off, and a voltage of the gate of the drive transistor T2 is unrelated to the data voltage Vdata. When the switch transistor T1 is in an off state, the voltage of the gate of the drive transistor T2 is maintained by the storage capacitor C. It can be understood that, if the storage capacitor C is not provided, the voltage of the gate of the drive transistor T2 may drift when the switch transistor T1 is in an off state, thereby affecting a display effect of the light-emitting element LED.

Figure 3:
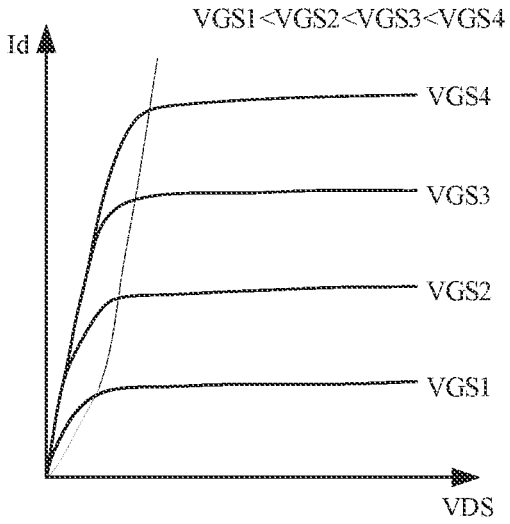
FIG. 3 is a schematic diagram illustrating an output characteristic of a transistor provided in the disclosure.

The drive transistor T2 is switched on according to the data voltage Vdata received by the gate of the drive transistor T2, and outputs a corresponding drain current according to a gate-source voltage VGS of the drive transistor T2. Since a light-emitting element LED is connected to the drive transistor T2 in series, a current Id driving the light-emitting element LED is the drain current of the drive transistor T2. Referring to FIG. 3, according to an output characteristic of a transistor, if the drive transistor T2 works in an amplification region, the current Id is positively correlated with the gate-source voltage VGS and a drain-source voltage VDS, where VDS=VDD−VSS, and VGS=VDD−Vdata.

Specifically, the current Id and the gate-source voltage VGS satisfy the following relationship:

$$Id = Id0 \times \left(\frac{VGS}{Vth} - 1\right)^2$$

where Vth represents a voltage threshold at which the drive transistor T2 is switched on (i.e., the drive transistor T2 is switched on when VSG>Vth), and Id0 represents a value of the current Id when VSG=2Vth.

Brightness of the light-emitting element LED has a positive correlation with the current Id, the current Id has a positive correlation with the gate-source voltage VGS of the drive transistor T2, and the voltage of the gate of the drive transistor T2 is maintained at Vdata by the storage capacitor C, therefore, the brightness of the light-emitting element LED is also positively correlated with the drive voltage VDD. In the display panel 100, the drive voltage VDD is supplied to each pixel unit 11 of the display panel 100 through a drive-voltage access end. Since a voltage drop (IR Drop) may occur during transmission of the drive voltage VDD, the closer a pixel unit 11 is to the drive-voltage access end, the higher a drive voltage VDD received by the pixel unit 11 and the higher the brightness. Conversely, the farther a pixel unit 11 is from the drive-voltage access end, the lower a drive voltage VDD received by the pixel unit 11 and the lower the brightness. As can be seen, for the display panel 100 using a P-type transistor as the drive transistor T2, a voltage drop on a trace for the drive voltage VDD is a main factor that causes decrease in uniformity of display brightness of the whole screen, and a voltage rise on a trace for the reference voltage VSS is a secondary factor that causes the decrease in the uniformity of the display brightness of the whole screen.

It should be noted that, in some implementations, the drive transistor T2 is an N-type transistor. In this situation, the first voltage-access-end 111 is electrically coupled with the cathode of the light-emitting element LED, and the anode of the light-emitting element LED is electrically coupled with the source of the drive transistor T2, to supply the reference voltage VSS (a low voltage) through the first voltage-access-end 111. The second voltage-access-end 112 is electrically coupled with the drain of the drive transistor T2, to supply the drive voltage VDD (a high voltage) through the second voltage-access-end 112. A difference between this circuit structure and the circuit structure illustrated in FIG. 2 lies in that: VSG=Vdata−VSS. The brightness of the light-emitting element LED has a positive correlation with the current Id, the current Id has a positive correlation with the gate-source voltage VGS of the drive transistor T2, and the voltage of the gate of the drive transistor T2 is maintained at Vdata by the storage capacitor C, therefore, the brightness of the light-emitting element LED is negatively correlated with the reference voltage VSS. Since a voltage rise may occur during transmission of the reference voltage VSS, the closer a pixel unit 11 is to the drive-voltage access end, the lower a reference voltage VSS received by the pixel unit 11 and the higher the brightness. Conversely, the farther a pixel unit 11 is from the drive-voltage access end, the higher a reference voltage VSS received by the pixel unit 11 and the lower the brightness. As can be seen, for the display panel 100 using an N-type transistor as the drive transistor T2, a voltage rise on a trace for the reference voltage VSS is a main factor that causes decrease in uniformity of display brightness of the whole screen, and a voltage drop on a trace for the drive voltage VDD is a secondary factor that causes the decrease in the uniformity of the display brightness of the whole screen.

Referring to FIG. 1 again, in implementations of the disclosure, the display panel 100 further includes a first voltage-main-line 21, a second voltage-main-line 22, a first input-unit 23, and a second input-unit 24. The first voltage-main-line 21 and the second voltage-main-line 22 each are arranged around a periphery of the display region 10. A first voltage-access-end 111 of each pixel unit 11 is electrically coupled with the first voltage-main-line 21 nearby, and a second voltage-access-end 112 of each pixel unit 11 is electrically coupled with the second voltage-main-line 22 nearby. In other words, the first voltage-access-end 111 of each pixel unit 11 is electrically coupled with the first voltage-main-line 21 at the part of the first-voltage main line 21 adjacent to the first voltage-access-end 111 (for example, at a position closest to the first voltage-access-end 111 on the first-voltage main line 21), and the second voltage-access-end 112 of each pixel unit 11 is electrically coupled with the second voltage-main-line 22 at the part of the second voltage-main-line 22 adjacent to the second voltage-access-end 112 (for example, at a position closest to the second voltage-access-end 112 on the second voltage-main-line 22). Further, the first voltage-main-line 21 and the second voltage-main-line 22 may be respectively disposed in different film layers of the display panel 100. The first voltage-main-line 21 and the second voltage-main-line 22 can have a shape corresponding to a shape of the display region 10 of the display panel 100. As an example, as illustrated in FIG. 1, both the first voltage-main-line 21 and the second voltage-main-line 22 are rectangular. Exemplarily, the first voltage-main-line 21 and the second voltage-main-line 22 each may be made of a copper-based metal, such as copper (Cu), copper-molybdenum alloy (Cu/Mo), copper-titanium alloy (Cu/Ti), copper-molybdenum-titanium alloy (Cu/Mo/Ti), or other suitable conductive metal materials.

In implementations of the disclosure, the first input-unit 23 and the second input-unit 24 are respectively located on a periphery of opposite sides of the display region 10 in a first direction (i.e., an OY direction illustrated in FIG. 1). The first input-unit 23 is electrically coupled with the first voltage-main-line 21 nearby and electrically coupled with the second voltage-main-line 22 nearby. Specifically, as illustrated in FIG. 1, the first input-unit 23 and part of the first voltage-main-line 21 for electrical coupling with the first input-unit 23 are located on a periphery of a same side of the display region 10. The first input-unit 23 and part of the second voltage-main-line 22 for electrical coupling with the first input-unit 23 are also located on the periphery of the same side of the display region 10. The first input-unit 23 is configured to supply a first voltage to the first voltage-main-line 21 and supply a second voltage to the second voltage-main-line 22. The second input-unit 24 is electrically coupled with the first voltage-main-line 21 nearby. Specifically, as illustrated in FIG. 1, the second input-unit 24 and part of the first voltage-main-line 21 for electrical coupling with the second input-unit 24 are located on a periphery of a same side of the display region 10. The second input-unit 24 is configured to supply the first voltage to the first voltage-main-line 21. Exemplarily, the first input-unit 23 may be disposed in a binding region (not illustrated) on one side of the display region 10, where the binding region is used to bind an external drive circuit, such as a driving chip IC (not illustrated) or a flexible circuit board FPC (not illustrated), etc. The first voltage-main-line 21, the second voltage-main-line 22, the first input-unit 23, and the second input-unit 24 each are arranged in the non-display region 20. In order to reduce a bezel of the display panel and increase a screen-to-body ratio of the display panel, the first input-unit 23 and the second input-unit 24 may be bent to back of the display region 10 of the display panel 100.

It should be noted that, in some implementations, if the drive transistor T2 is a P-type transistor, as described above, the voltage drop of the drive voltage VDD has a greater impact on the uniformity of the brightness of the display panel 100, and therefore, the first voltage-main-line 21 is a trace for the drive voltage VDD, the second voltage-main-line 22 is a trace for the reference voltage VSS, the first voltage is the drive voltage VDD, and the second voltage is the reference voltage VSS. In other implementations, if the drive transistor T2 is an N-type transistor, the voltage rise of the reference voltage VSS has a greater impact on the uniformity of the brightness of the display panel 100, and therefore, the first voltage-main-line is a trace for the reference voltage VSS, the second voltage-main-line is a trace for the drive voltage VDD, the first voltage is the reference voltage VSS, and the second voltage is the drive voltage VDD.

According to the display panel 100 of the disclosure, by providing the first voltage-main-line 21 and the second voltage-main-line 22 around the periphery of the display region 10, and providing the first input-unit 23 and second input-unit 24 on a periphery of opposite sides of the display panel 100 in the first direction, the first voltage can be supplied to the first voltage-main-line 21 respectively through the first input-unit 23 and the second input-unit 24, so that the first voltage can be transmitted to each pixel unit from the opposite sides of the display region 10, which can significantly reduce a difference between first voltages received by pixel units on the opposite sides of the display region, thereby improving uniformity of brightness of the display panel and a user experience.

Further, the first input-unit 23 includes at least one set of power input ports. Each set of power input ports includes a first voltage-input-port 231 and a second voltage-input-port 232. The first voltage-input-port 231 is electrically coupled with the first voltage-main-line 21 nearby via a lead, and the second voltage-input-port 232 is electrically coupled with the second voltage-main-line 22 nearby via a lead. The first input-unit 23 is located on a periphery of a first side 101 of the display region 10. In the implementation illustrated in FIG. 1, the first input-unit 23 includes one set of power input ports, and the set of power input ports includes a first voltage-input-port 231 and a second voltage-input-port 232, where the first voltage-input-port 231 is electrically coupled with the first voltage-main-line 21 at the middle part of the first voltage-main-line 21 on the first side 101 of the display region 10, and the second voltage-input-port 232 is electrically coupled with the second voltage-main-line 22 at the middle part of the second voltage-main-line 22 on the first side 101 of the display region 10.

Further, the second input-unit 24 includes at least one set of power input ports. Each set of power input ports at least includes a first voltage-input-port 241, where the first voltage-input-port 241 is electrically coupled with the first voltage-main-line 21 nearby via a lead. The second input-unit 24 is located on a periphery of a second side 102 of the display region 10, where the first side 101 is opposite to the second side 102. In the implementations illustrated in FIG. 1, the second input-unit 24 includes one set of power input ports, and the set of power input ports includes a first voltage-input-port 241, where the first voltage-input-port 241 is electrically coupled with the first voltage-main-line 21 at the middle part of the first voltage-main-line 21 on the second side 102 of the display region 10. During operation, each first voltage-input-port 231 of the first input-unit 23 and each first voltage-input-port 241 of the second input-unit 24 have equal potential.

Figure 4:
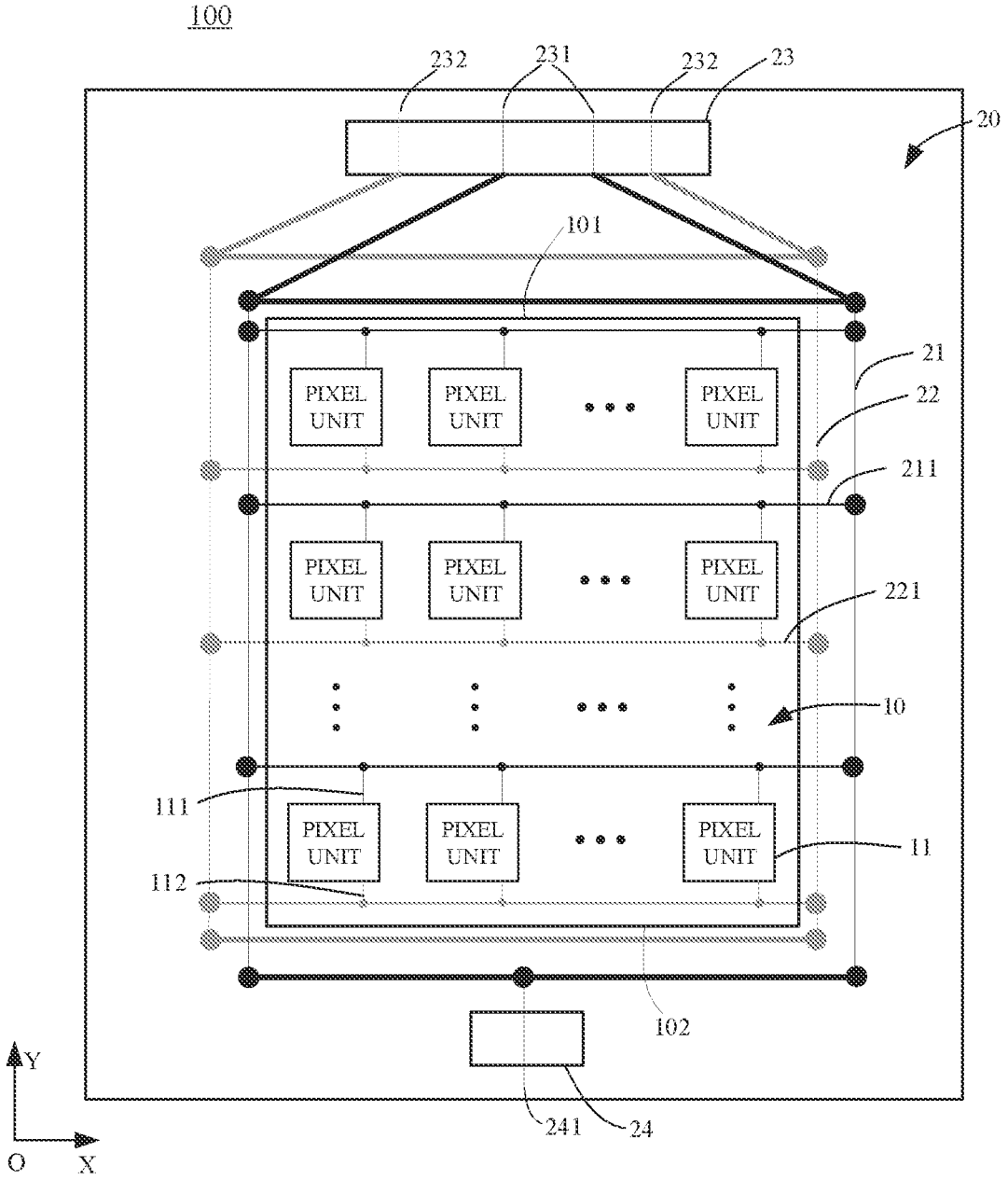
FIG. 4 is a schematic structural diagram illustrating a Micro-LED display panel provided in other implementations of the disclosure.

Referring to FIG. 4, FIG. 4 illustrates a Micro-LED display panel provided in other implementations of the disclosure. Compared to the implementations illustrated in FIG. 1, a difference lies in that: the first input-unit 23 includes a first set of power input ports and a second set of power input ports. The first set of power input ports includes a first voltage-input-port 231 and a second voltage-input-port 232, where the first voltage-input-port 231 is electrically coupled with a first end of the first voltage-main-line 21 on the first side 101 of the display region 10, and the second voltage-input-port 232 is electrically coupled with a first end of the second voltage-main-line 22 on the first side 101 of the display region 10. The second set of power input ports includes a first voltage-input-port 231 and a second voltage-input-port 232, where the first voltage-input-port 231 is electrically coupled with a second end of the first voltage-main-line 21 on the first side 101 of the display region 10, and the second voltage-input-port 232 is electrically coupled with a second end of the second voltage-main-line 22 on the first side 101 of the display region 10. The first end and the second end of each voltage-main-line (e.g., the first voltage-main-line 21 and the second voltage-main-line 22) are opposite to each other. As illustrated in FIG. 4, the first end and the second end of the first voltage-main-line 21 are located on the periphery of the first side 101 of the display region 10, and are opposite to each other in an OX direction.

Optionally, the display panel 100 further includes multiple first connection lines 211 arranged in parallel. Each of the first connection lines 211 extends along a second direction (the OX direction illustrated in FIG. 4). Two ends of each of the first connection lines 211 are electrically coupled with the first voltage-main-line 21. A first voltage-access-end 111 of each pixel unit 11 is coupled with a first connection line 211 nearby, to be electrically coupled with the first voltage-main-line 21 via the first connection line 211 to receive the first voltage. The second direction is at a preset angle (e.g., 90 degrees) from the first direction. It can be understood that, with aid of the multiple first connection lines 211, pixel units 11 in a same row can receive the first voltage through a same first connection line 211. As such, consistency of first voltages received by the pixel units 11 in the same row can be improved, thereby improving uniformity of brightness of the pixel units 11 in the same row.

Figure 5:
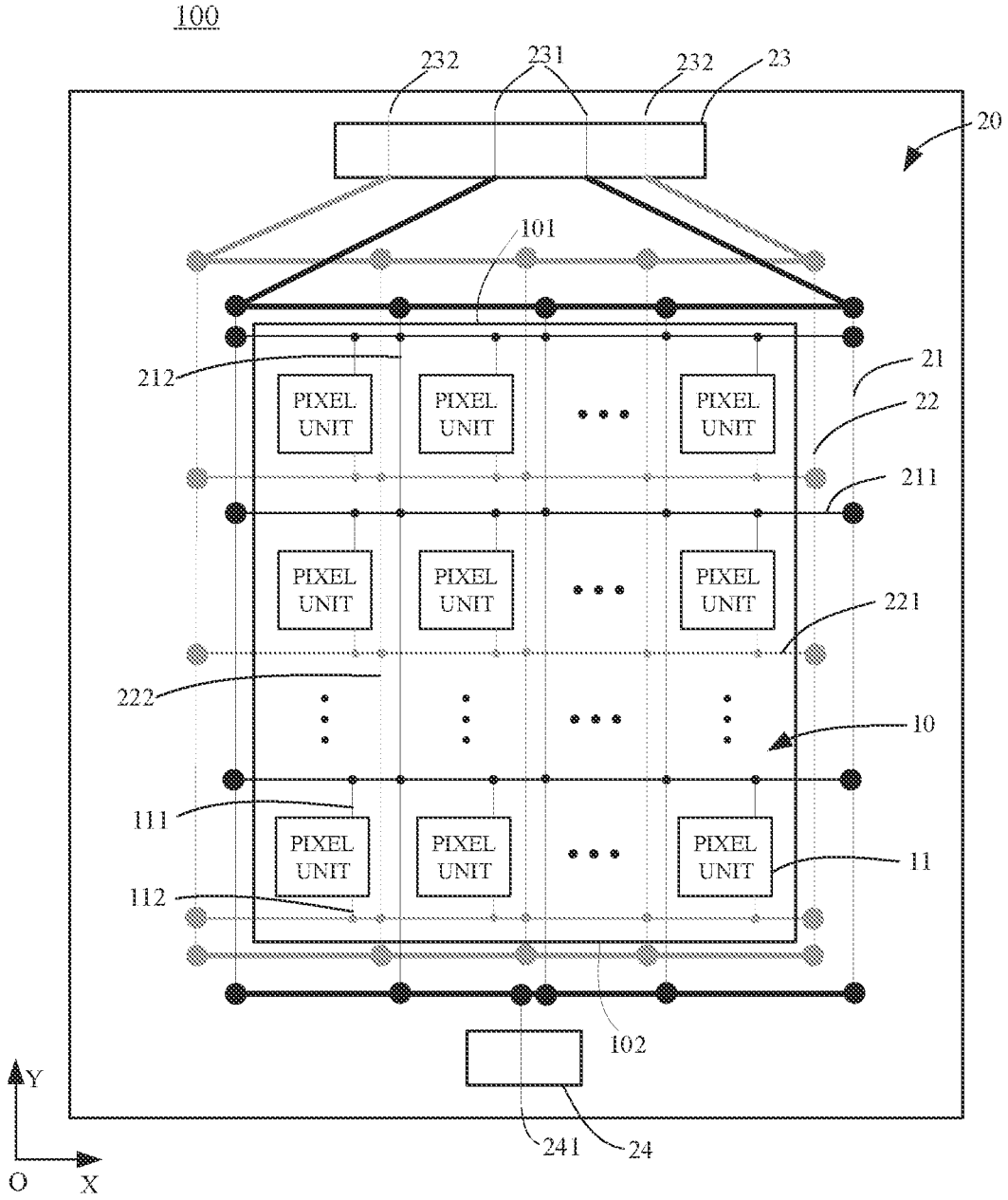
FIG. 5 is a schematic structural diagram illustrating a Micro-LED display panel provided in other implementations of the disclosure.

Referring to FIG. 5, FIG. 5 illustrates a Micro-LED display panel provided in other implementations of the disclosure. Compared to the implementations illustrated in FIG. 4, a difference lies in that: the display panel 100 further includes multiple second connection lines 212 arranged in parallel. Each of the second connection lines extends along the first direction. Two ends of each of the second connection lines are electrically coupled with the first voltage-main-line 21. The multiple first connection lines 211 and the multiple second connection lines 212 cooperatively form a first power grid including multiple grid units, so that a first voltage-access-end 111 of each pixel unit 11 is electrically coupled with a corresponding grid unit. It can be understood that, compared to the implementations illustrated in FIG. 4, by providing the multiple second connection lines 212, consistency of first voltages received by pixel units 11 can be further improved, thereby further improving uniformity of brightness of the display panel 100. Both the first connection line 211 and the second connection line 212 can receive the first voltage from the first voltage-main-line 21, and therefore, a current flowing through the first connection line 211 and a current flowing through the second connection line 212 each are smaller than a current flowing through the first voltage-main-line 21. In implementations of the disclosure, a cross-sectional area of the first voltage-main-line 21 is larger than a cross-sectional area of the first connection line 211 and larger than a cross-sectional area of the second connection line 212. As such, a cross-sectional area of a trace can be set according to the magnitude of a drive current in the trace, which can reduce impedance of the trace, so that voltage variation (voltage drop or voltage rise) of the first voltage can be further reduced during transmission of the first voltage, thereby further improving uniformity of brightness of the display panel 100.

Optionally, the display panel 100 further includes multiple third connection lines 221 arranged in parallel. Each of the third connection lines 221 extends along the second direction. Two ends of each of the third connection lines 221 are electrically coupled with the second voltage-main-line 22. A second voltage-access-end of each pixel unit 11 is coupled with a third connection line 221 nearby, to be electrically coupled with the second voltage-main-line 22 via the third connection line 221 to receive the second voltage. It should be noted that, as mentioned above, the current Id is positively correlated with the gate-source voltage VGS and the drain-source voltage VDS. If voltage variation of the first voltage is reduced during transmission of the first voltage and voltage variation of the second voltage is reduced during transmission of the second voltage (that is, the voltage drop of the drive voltage VDD is reduced, and the voltage rise of the reference voltage VSS is reduced), not only the gate-source voltage VGS but also the drain-source voltage VDS can be increased, which can further improve uniformity of brightness of the display panel 100. Therefore, the multiple third connection lines 221 can further improve uniformity of brightness of pixel units 11 in a same row.

Optionally, the display panel 100 further includes multiple fourth connection lines 222 arranged in parallel. Each of the fourth connection lines 222 extends along the first direction. Two ends of each of the fourth connection lines 222 are electrically coupled with the second voltage-main-line 22. The multiple third connection lines 221 and the multiple fourth connection lines 222 cooperatively form a second power grid including multiple grid units, so that a second voltage-access-end 112 of each pixel unit 11 is electrically coupled with a corresponding grid unit. It can be understood that, compared to the implementations illustrated in FIG. 4, by providing the multiple fourth connection lines 222, consistency of second voltages received by pixel units 11 can be further improved, thereby further improving uniformity of brightness of the display panel 100. In implementations of the disclosure, a cross-sectional area of the second voltage-main-line 22 is larger than a cross-sectional area of the third connection line 221 and larger than a cross-sectional area of the fourth connection line 222. As such, voltage variation (voltage drop or voltage rise) of the second voltage can be further reduced during transmission of the second voltage to each pixel unit 11, thereby further improving uniformity of brightness of the display panel 100.

Figure 6:
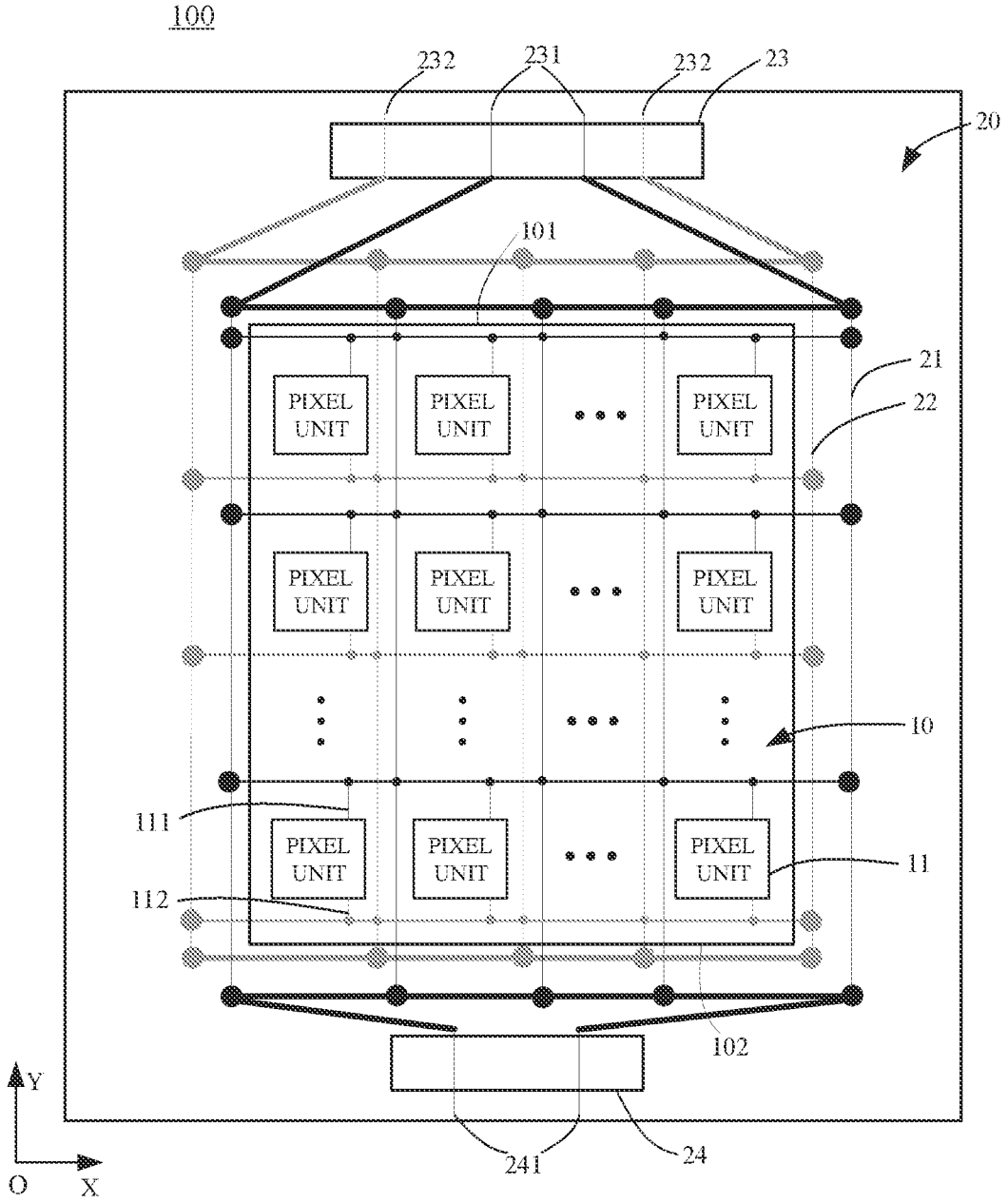
FIG. 6 is a schematic structural diagram illustrating a Micro-LED display panel provided in other implementations of the disclosure.

Referring to FIG. 6, FIG. 6 illustrates a Micro-LED display panel provided in other implementations of the disclosure. Compared to the implementations illustrated in FIG. 5, a difference lies in that: the second input-unit 24 includes two sets of power input ports. One set of power input ports in the second input-unit 24 includes a first voltage-input-port 241, where the first voltage-input-port 241 is electrically coupled with a third end of the first voltage-main-line 21 on the second side 102 of the display region 10. The other set of power input ports in the second input-unit 24 includes a first voltage-input-port 241, where the first voltage-input-port 241 is electrically coupled with a fourth end of the first voltage-main-line 21 on the second side 102 of the display region 10. The third end and the fourth end of each voltage-main-line (e.g., the first voltage-main-line 21 and the second voltage-main-line 22) are opposite to each other. As illustrated in FIG. 6, the third end and the fourth end of the first voltage-main-line 21 are located on the periphery of the second side 102 of the display region 10, and are opposite to each other in the OX direction. As can be seen, the first voltage-main-line 21 can respectively receive from the above four ends the first voltage introduced by the first voltage-input-port, and therefore, uniformity of brightness of the display panel 100 provided in these implementations is better than uniformity of brightness of the display panel 100 provided in the implementations illustrated in FIG. 5.

Figure 7:
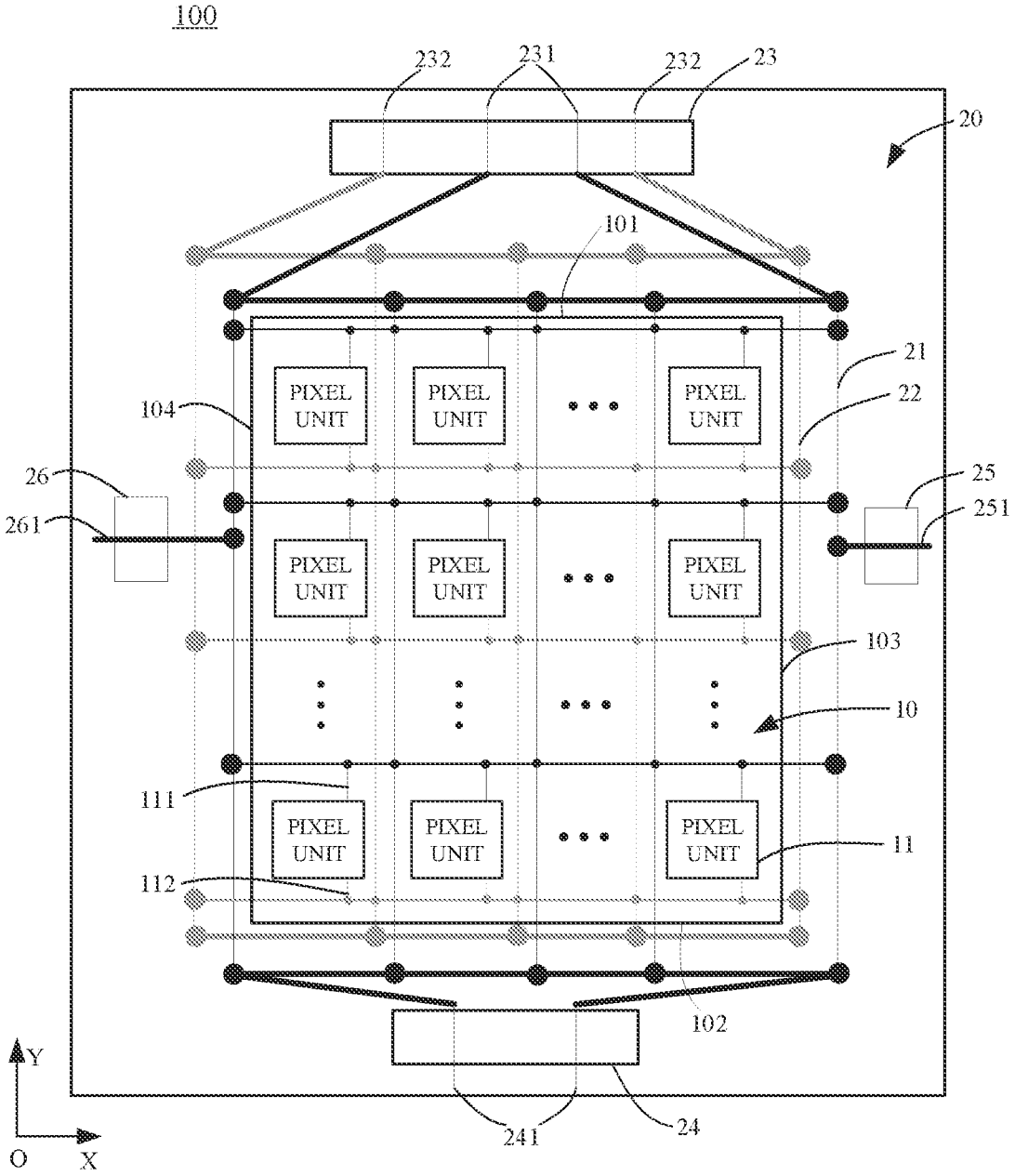
FIG. 7 is a schematic structural diagram illustrating a Micro-LED display panel provided in other implementations of the disclosure.

Referring to FIG. 7, FIG. 7 illustrates a Micro-LED display panel provided in other implementations of the disclosure. Compared to the implementations illustrated in FIG. 6, a difference lies in that: the display panel 100 further includes a third input-unit 25 and a fourth input-unit 26. The third input-unit 25 and the fourth input-unit 26 are located on a periphery of opposite sides of the display region 10 in the second direction. The third input-unit 25 and the fourth input-unit 26 each are electrically coupled with the first voltage-main-line 21, to supply the first voltage to the first voltage-main-line 21. During operation, each first voltage-input-port 231 of the first input-unit 23, each first voltage-input-port 241 of the second input-unit 24, each first voltage-input-port 251 of the third input-unit 25, and each first voltage-input-port 261 of the fourth input-unit 26 have equal potential. Exemplarily, both the third input-unit 25 and the fourth input-unit 26 are arranged in the non-display region 20.

Further, the third input-unit 25 and the fourth input-unit 26 each include at least one set of power input ports. Each set of power input ports at least includes a first voltage-input-port, where the first voltage-input-port is electrically coupled with the first voltage-main-line 21 nearby via a lead.

Further, the third input-unit 25 is located on a periphery of a third side 103 of the display region 10, and the fourth input-unit 26 is located on a periphery of a fourth side 104 of the display region 10. The third input-unit 25 includes one set of power input ports, where the set of power input ports includes a first voltage-input-port 251, and the first voltage-input-port 251 is electrically coupled with the first voltage-main-line 21 at the middle part of the first voltage-main-line 21 on the third side 103 of the display region 10. The fourth input-unit 26 includes one set of power input ports, where the set of power input ports includes a first voltage-input-port 261, and the first voltage-input-port 261 is electrically coupled with the first voltage-main-line 21 at the middle part of the first voltage-main-line 21 on the fourth side 104 of the display region 10. As can be seen, compared to the implementations illustrated in FIG. 6, the display panel 100 of these implementations further provides the first voltage-input-port 251 on the third side 103 of the display region 10 and the first voltage-input-port 261 on the fourth side 104 of the display region 10, which can shorten a length of a trace between a pixel unit 11 in the middle of the display region 10 along the OY direction and the first voltage-input-port, so that brightness of the pixel unit 11 in the middle of the display region 10 can be increased, thereby further improving uniformity of brightness of the display panel 100.

Figure 8:
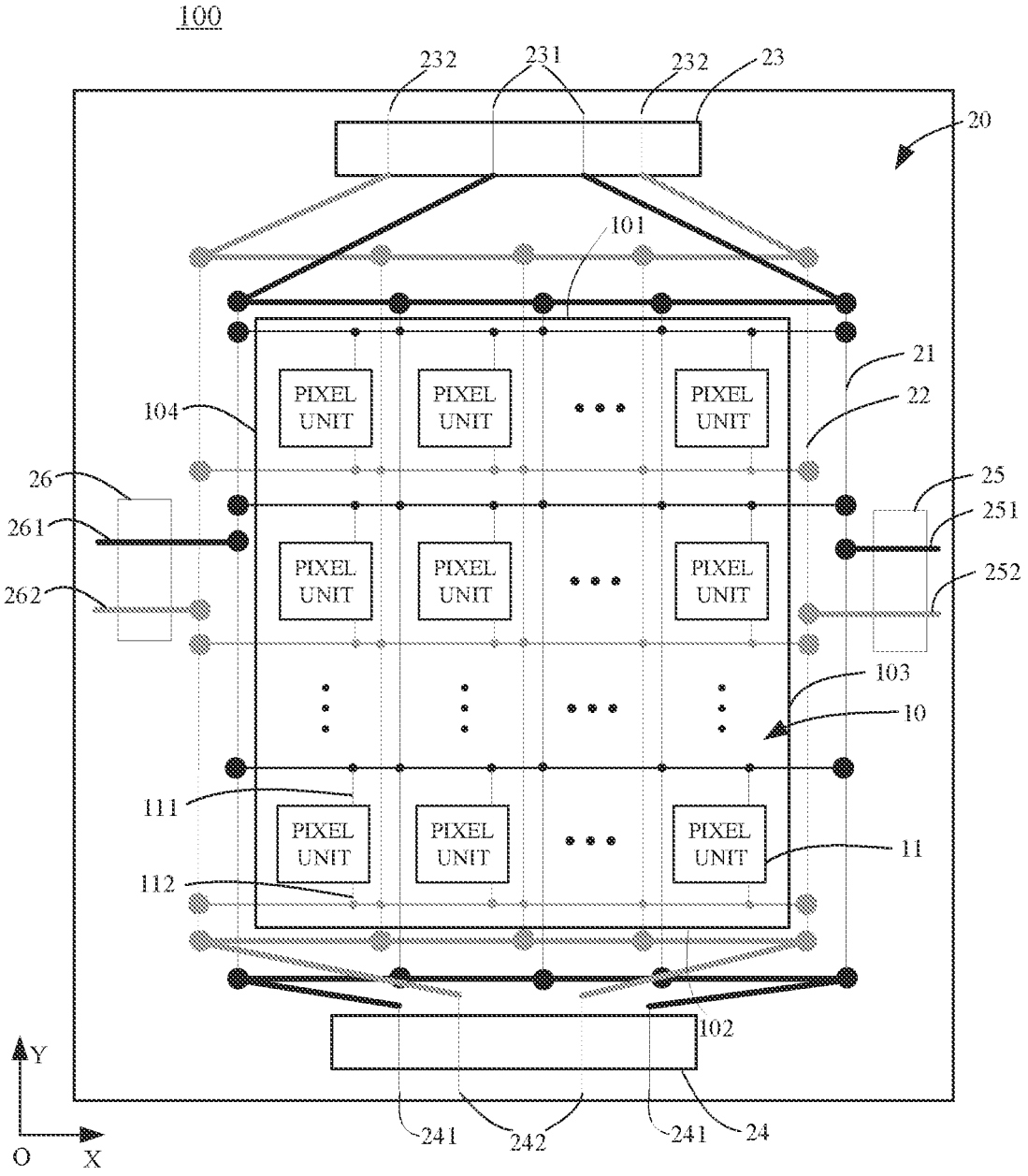
FIG. 8 is a schematic structural diagram illustrating a Micro-LED display panel provided in other implementations of the disclosure.

Referring to FIG. 8, FIG. 8 illustrates a Micro-LED display panel provided in other implementations of the disclosure. Compared to the implementations illustrated in FIG. 7, a difference lies in that: layout of a trace for the second voltage is the same as layout of a trace for the first voltage.

Specifically, the second input-unit 24 is further electrically coupled with the second voltage-main-line 22 nearby, to supply the second voltage to the second voltage-main-line 22 through the second input-unit 24. Each set of power input ports in the second input-unit 24 further includes a second voltage-input-port 242. The first set of power input ports in the second input-unit 24 includes a second voltage-input-port 242, where the second voltage-input-port 242 is electrically coupled with a third end of the second voltage-main-line 22 on the second side 102 of the display region 10. The second set of power input ports in the second input-unit 24 includes a second voltage-input-port 242, where the second voltage-input-port 242 is electrically coupled with a fourth end of the second voltage-main-line 22 on the second side 102 of the display region 10. The third end and the fourth end of the second voltage-main-line 22 are located on the periphery of the second side 102 of the display region 10, and are opposite to each other in the OX direction.

Further, the third input-unit 25 is further electrically coupled with the second voltage-main-line 22 nearby, and the fourth input-unit 26 is further electrically coupled with the second voltage-main-line 22 nearby, to supply the second voltage to the second voltage-main-line 22 through the third input-unit 25 and the fourth input-unit 26.

Further, each set of power input ports in the third input-unit 25 further includes a second voltage-input-port, and each set of power input ports in the fourth input-unit 26 further includes a second voltage-input-port. The second voltage-input-port 252 in the set of the power input ports of the third input-unit 25 is electrically coupled with the second voltage-main-line 22 at the middle part of the second voltage-main-line 22 on the third side 103 of the display region 10. The second voltage-input-port 262 in the set of the power input ports of the fourth input-unit 26 is electrically coupled with the second voltage-main-line 22 at the middle part of the second voltage-main-line 22 on the fourth side 104 of the display region 10.

It can be understood that, as mentioned above, the current Id has a positive correlation with the gate-source voltage VGS and the drain-source voltage VDS, and therefore, in the display panel 100 of these implementations, by setting the layout of the trace for the second voltage to be the same as the layout of the trace for the first voltage, voltage variation of the first voltage can be reduced during transmission of the first voltage and voltage variation of the second voltage can be reduced during transmission of the second voltage (that is, the voltage drop of the drive voltage VDD is reduced, and the voltage rise of the reference voltage VSS is reduced). As such, not only the gate-source voltage VGS but also the drain-source voltage VDS can be increased, which can further improve uniformity of brightness of the display panel 100.

Figure 9:
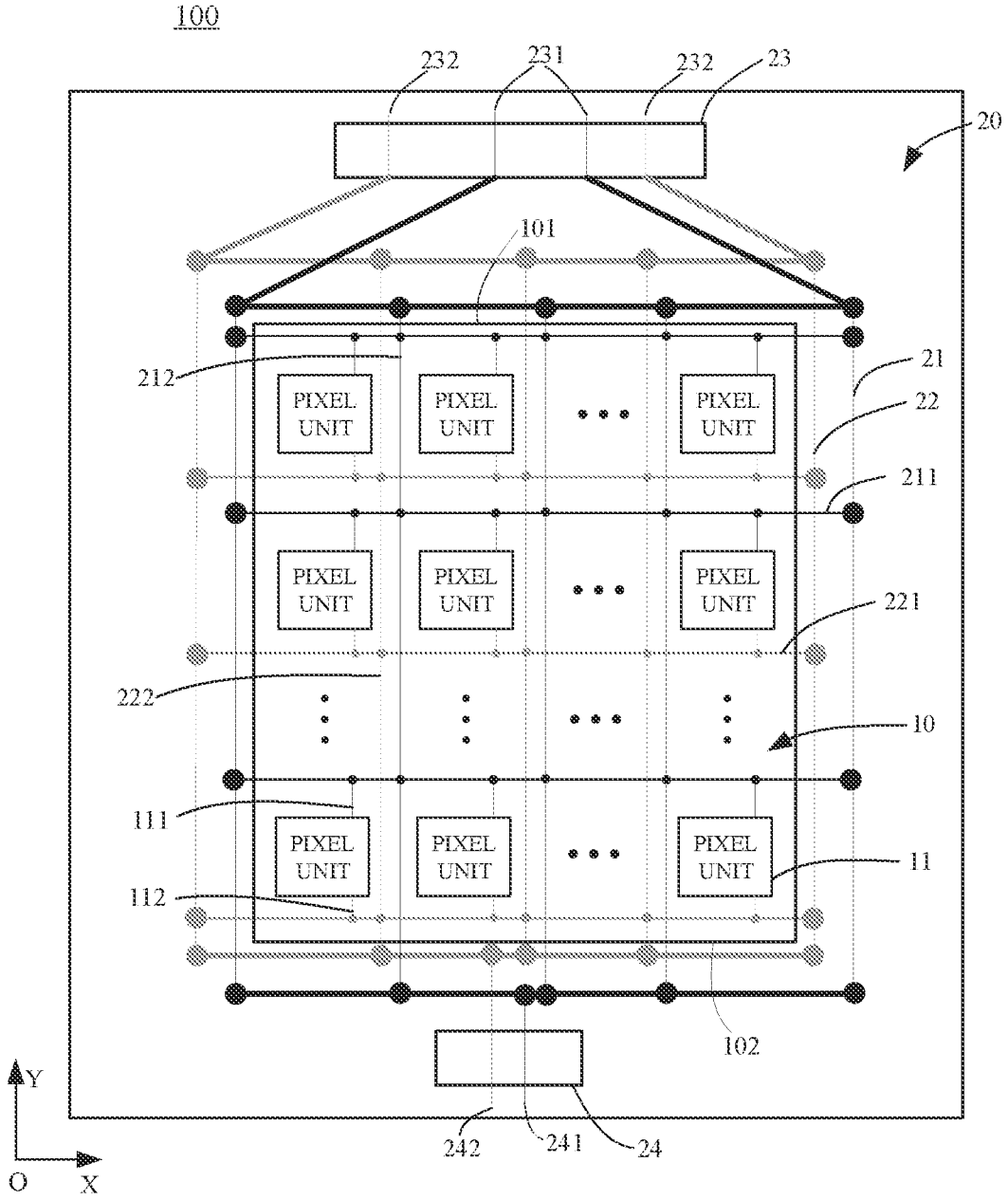
FIG. 9 is a schematic structural diagram illustrating a Micro-LED display panel provided in other implementations of the disclosure.
Figure 10:
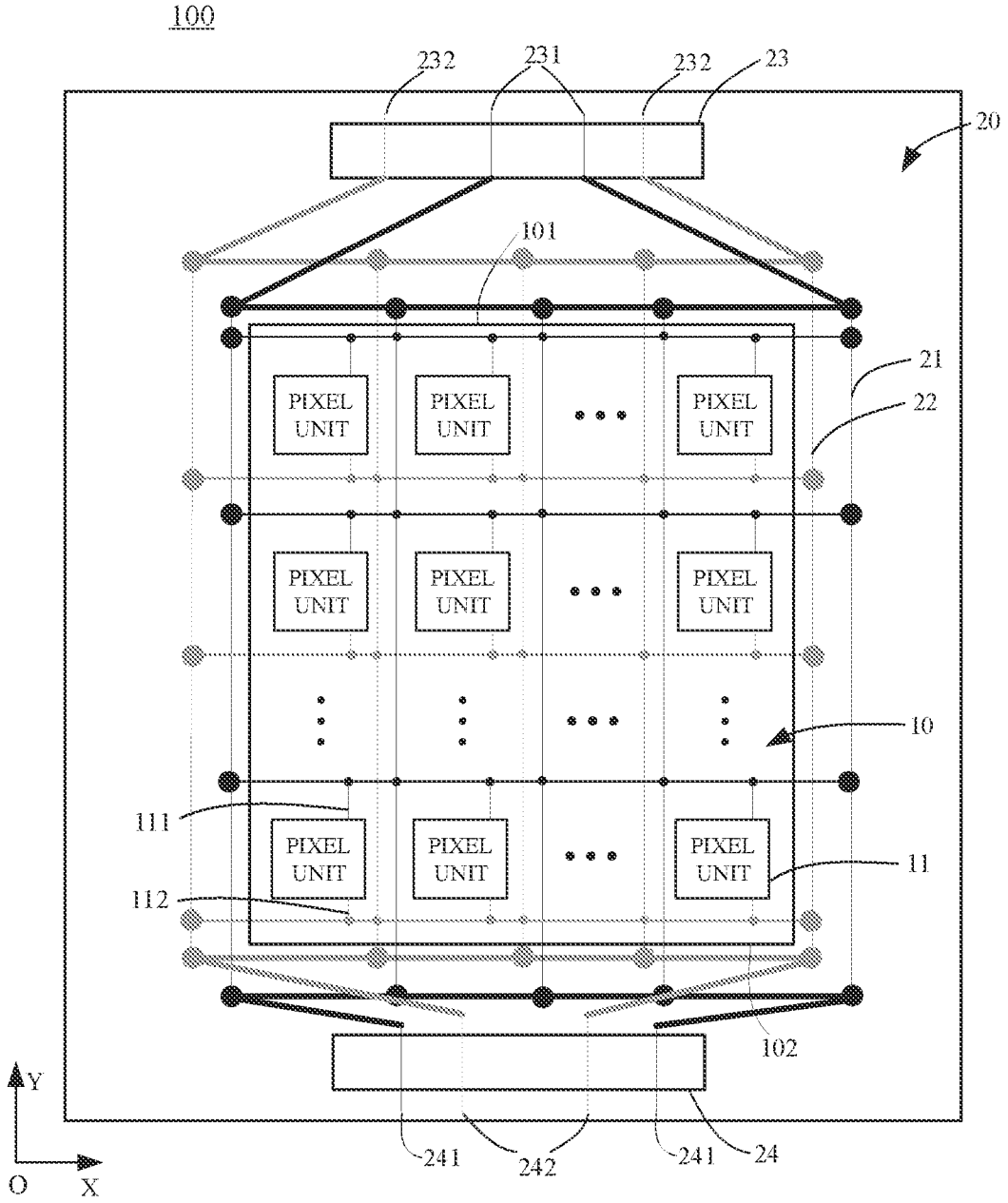
FIG. 10 is a schematic structural diagram illustrating a Micro-LED display panel provided in other implementations of the disclosure.

It can be understood that, in other implementations, the layout of the trace for the second voltage is set to be the same as the layout of the trace for the first voltage. Exemplarily, referring to FIG. 9 and FIG. 10, FIG. 9 illustrates a Micro-LED display panel provided in other implementations of the disclosure. Compared to the implementations illustrated in FIG. 5, a difference lies in that: the second input-unit 24 is further electrically coupled with the second voltage-main-line 22 nearby, to supply the second voltage to the second voltage-main-line 22 through the second input-unit 24; the set of power input ports in the second input-unit further includes a second voltage-input-port 242, where the second voltage-input-port 242 is electrically coupled with the second voltage-main-line 22 at the middle part of the second voltage-main-line 22 on the second side 102 of the display region 10.

FIG. 10 illustrates a Micro-LED display panel provided in other implementations of the disclosure. Compared to the implementations illustrated in FIG. 6, a difference lies in that: the second input-unit 24 is further electrically coupled with the second voltage-main-line 22, to supply the second voltage to the second voltage-main-line 22 through the second input-unit 24. Each set of power input ports in the second input-unit 24 further includes a second voltage-input-port 242. A second voltage-input-port 242 in the first set of power input ports of the second input-unit 24 is electrically coupled with the third end of the second voltage-main-line 22 on the second side 102 of the display region 10. A second voltage-input-port 242 in the second set of power input ports of the second input-unit 24 is electrically coupled with the fourth end of the second voltage-main-line 22 on the second side 102 of the display region 10. The third end and the fourth end of the second voltage-main-line 22 are located on the periphery of the second side 102 of the display region 10, and are opposite to each other in the OX direction.

In some implementations, each input-unit may include N sets of power input ports, where N may be greater than 2, which is not limited herein. First voltage-input-ports of respective sets of power input ports in a same input-unit may be electrically coupled with the first voltage-main-line 21 at corresponding parts of the first voltage-main-line 21 in an equidistant manner. As an example, the first input-unit 23 includes five sets of power input ports (not illustrated), where first voltage-input-ports 231 of the five sets of power input ports are electrically coupled with the first voltage-main-line 21 at parts of the first voltage-main-line 21 on the periphery of the first side 101 of the display region 10 in an equidistant manner. It can be understood that, the more sets of power input ports in a same input-unit, the better uniformity of brightness of the display panel 100.

Figure 11:
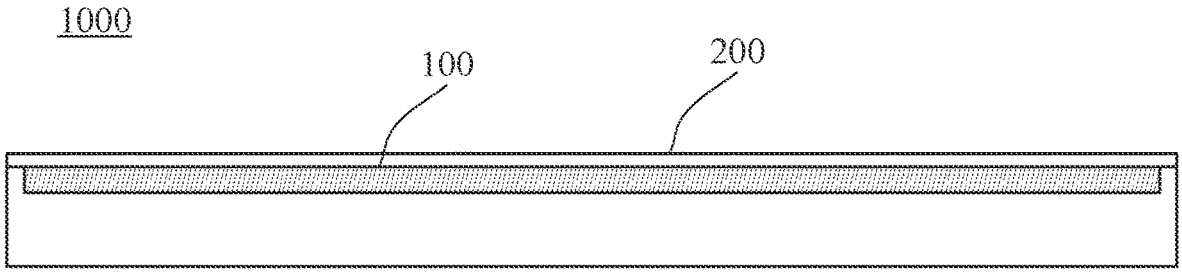
FIG. 11 is a schematic structural diagram illustrating a display device provided in implementations of the disclosure.

Implementations of the disclosure further provide a display device 1000. The display device 1000 includes a housing 200 and the above Micro-LED display panel 100. As illustrated in FIG. 11, the housing 200 defines a receiving cavity, and the display panel 100 is received in the receiving cavity.

The type of the display device 1000 is not particularly limited in the disclosure. The display device 1000 may be any device with a display function in the art, such as but not limited to a desktop computer, a tablet computer, a notebook computer, a mobile phone, a Personal Digital Assistant (PDA), a Global Positioning System (GPS), a in-vehicle display, a projection display, a camera, a digital camera, an electronic watch, a calculator, an electronic instrument, a meter, an LCD panel, electronic paper, a television, a monitor, a digital photo frame, a navigator, etc.

While the implementations of the disclosure have been illustrated and depicted above, it will be understood by those of ordinary skill in the art that various changes, modifications, substitutions, and alterations can be made to these implementations without departing from the principles and spirits of the disclosure. Therefore, the scope of the disclosure is defined by the appended claims and equivalents of the appended claims.

What is claimed is:

1. A Micro Light Emitting Diode (Micro-LED) display panel, having a display region provided with a plurality of pixel units, the plurality of pixel units each comprising a first voltage-access-end and a second voltage-access-end, the Micro-LED display panel comprising:

a first voltage-main-line and a second voltage-main-line each surrounding the display region, wherein a first voltage-access-end of each of the plurality of pixel units is electrically coupled with the first voltage-main-line nearby, and a second voltage-access-end of each of the plurality of pixel units is electrically coupled with the second voltage-main-line nearby; and a first input-unit and a second input-unit respectively located on a periphery of opposite sides of the display region in a first direction, wherein the first input-unit is electrically coupled with the first voltage-main-line nearby and electrically coupled with the second voltage-main-line nearby, to supply a first voltage to the first voltage-main-line and supply a second voltage to the second voltage-main-line; wherein the second input-unit is electrically coupled with the first voltage-main-line nearby, to supply the first voltage to the first voltage-main-line.

2. The Micro-LED display panel of claim 1, wherein the first input-unit comprises at least one set of power input ports, each set of power input ports comprises a first voltage-input-port and a second voltage-input-port, wherein the first voltage-input-port is electrically coupled with the first voltage-main-line nearby via a lead, and the second voltage-input-port is electrically coupled with the second voltage-main-line nearby via a lead.

3. The Micro-LED display panel of claim 2, wherein the first input-unit is located on a periphery of a first side of the display region, and comprises a first set of power input ports and a second set of power input ports, wherein the first set of power input ports comprises a first voltage-input-port and a second voltage-input-port, wherein the first voltage-input-port in the first set is electrically coupled with a first end of the first voltage-main-line on the first side of the display region, and the second voltage-input-port in the first set is electrically coupled with a first end of the second voltage-main-line on the first side of the display region;

the second set of power input ports comprises a first voltage-input-port and a second voltage-input-port, wherein the first voltage-input-port in the second set is electrically coupled with a second end of the first voltage-main-line on the first side of the display region, and the second voltage-input-port in the second set is electrically coupled with a second end of the second voltage-main-line on the first side of the display region; and the first end of the first voltage-main-line is opposite to the second end of the first voltage-main-line, and the first end of the second voltage-main-line is opposite to the second end of the second voltage-main-line.

4. The Micro-LED display panel of claim 1, wherein the second input-unit comprises at least one set of power input ports, each set of power input ports at least comprises a first voltage-input-port, wherein the first voltage-input-port is electrically coupled with the first voltage-main-line nearby via a lead.

5. The Micro-LED display panel of claim 1, further comprising a third input-unit and a fourth input-unit, the third input-unit and the fourth input-unit being respectively located on a periphery of opposite sides of the display region in a second direction, wherein the third input-unit is electrically coupled with the first voltage-main-line nearby and the fourth input-unit is electrically coupled with the first voltage-main-line nearby, to supply the first voltage to the first voltage-main-line; wherein the second direction is at a preset angle from the first direction.

6. The Micro-LED display panel of claim 5, wherein the third input-unit and the fourth input-unit each comprise at least one set of power input ports, each set of power input ports at least comprises a first voltage-input-port, wherein the first voltage-input-port is electrically coupled with the first voltage-main-line nearby via a lead.

7. The Micro-LED display panel of claim 5, wherein the Micro-LED display panel further has a non-display region surrounding the display region, wherein the first voltage-main-line, the second voltage-main-line, the first input-unit, the second input-unit, the third input-unit, and the fourth input-unit are disposed in the non-display region.

8. The Micro-LED display panel of claim 1, further comprising a plurality of first connection lines arranged in parallel, wherein the first connection lines each extend along a second direction;

two ends of each of the first connection lines are electrically coupled with the first voltage-main-line;

a first voltage-access-end of each of the pixel units is coupled with a first connection line nearby, to be electrically coupled with the first voltage-main-line via the first connection line to receive the first voltage; and the second direction is at a preset angle from the first direction.

9. The Micro-LED display panel of claim 8, further comprising a plurality of second connection lines arranged in parallel, wherein the second connection lines each extend along the first direction;

two ends of each of the second connection lines are electrically coupled with the first voltage-main-line;

the plurality of second connection lines and the plurality of first connection lines cooperatively form a power grid comprising a plurality of grid units; and a first voltage-access-end of each of the pixel units is electrically coupled with a corresponding grid unit, to be electrically coupled with the first voltage-main-line to receive the first voltage.

10. The Micro-LED display panel of claim 1, wherein the first voltage-main-line is a drive-voltage line, the second voltage-main-line is a reference-voltage line, the first voltage is a drive voltage, and the second voltage is a reference voltage; or the first voltage-main-line is a reference-voltage line, the second voltage-main-line is a drive-voltage line, the first voltage is a reference voltage, and the second voltage is a drive voltage.

11. A display device, comprising:

a housing, defining a receiving cavity; and a Micro Light Emitting Diode (Micro-LED) display panel, received in the receiving cavity and having a display region provided with a plurality of pixel units, the plurality of pixel units each comprising a first voltage-access-end and a second voltage-access-end, the Micro-LED display panel comprising:

a first voltage-main-line and a second voltage-main-line each surrounding the display region, wherein a first voltage-access-end of each of the plurality of pixel units is electrically coupled with the first voltage-main-line nearby, and a second voltage-access-end of each of the plurality of pixel units is electrically coupled with the second voltage-main-line nearby; and a first input-unit and a second input-unit respectively located on a periphery of opposite sides of the display region in a first direction, wherein the first input-unit is electrically coupled with the first voltage-main-line nearby and electrically coupled with the second voltage-main-line nearby, to supply a first voltage to the first voltage-main-line and supply a second voltage to the second voltage-main-line; wherein the second input-unit is electrically coupled with the first voltage-main-line nearby, to supply the first voltage to the first voltage-main-line.

12. The display device of claim 11, wherein the first input-unit comprises at least one set of power input ports, each set of power input ports comprises a first voltage-input-port and a second voltage-input-port, wherein the first voltage-input-port is electrically coupled with the first voltage-main-line nearby via a lead, and the second voltage-input-port is electrically coupled with the second voltage-main-line nearby via a lead.

13. The display device of claim 12, wherein the first input-unit is located on a periphery of a first side of the display region, and comprises a first set of power input ports and a second set of power input ports, wherein the first set of power input ports comprises a first voltage-input-port and a second voltage-input-port, wherein the first voltage-input-port in the first set is electrically coupled with a first end of the first voltage-main-line on the first side of the display region, and the second voltage-input-port in the first set is electrically coupled with a first end of the second voltage-main-line on the first side of the display region;

the second set of power input ports comprises a first voltage-input-port and a second voltage-input-port, wherein the first voltage-input-port in the second set is electrically coupled with a second end of the first voltage-main-line on the first side of the display region, and the second voltage-input-port in the second set is electrically coupled with a second end of the second voltage-main-line on the first side of the display region; and the first end of the first voltage-main-line is opposite to the second end of the first voltage-main-line, and the first end of the second voltage-main-line is opposite to the second end of the second voltage-main-line.

14. The display device of claim 11, wherein the second input-unit comprises at least one set of power input ports, each set of power input ports at least comprises a first voltage-input-port, wherein the first voltage-input-port is electrically coupled with the first voltage-main-line nearby via a lead.

15. The display device of claim 11, wherein the Micro-LED display panel further comprises a third input-unit and a fourth input-unit, the third input-unit and the fourth input-unit being respectively located on a periphery of opposite sides of the display region in a second direction, wherein the third input-unit is electrically coupled with the first voltage-main-line nearby and the fourth input-unit is electrically coupled with the first voltage-main-line nearby, to supply the first voltage to the first voltage-main-line; wherein the second direction is at a preset angle from the first direction.

16. The display device of claim 15, wherein the third input-unit and the fourth input-unit each comprise at least one set of power input ports, each set of power input ports at least comprises a first voltage-input-port, wherein the first voltage-input-port is electrically coupled with the first voltage-main-line nearby via a lead.

17. The display device of claim 15, wherein the Micro-LED display panel further has a non-display region surrounding the display region, wherein the first voltage-main-line, the second voltage-main-line, the first input-unit, the second input-unit, the third input-unit, and the fourth input-unit are disposed in the non-display region.

18. The display device of claim 11, wherein the Micro-LED display panel further comprises a plurality of first connection lines arranged in parallel, wherein the first connection lines each extend along a second direction;

two ends of each of the first connection lines are electrically coupled with the first voltage-main-line;

a first voltage-access-end of each of the pixel units is coupled with a first connection line nearby, to be electrically coupled with the first voltage-main-line via the first connection line to receive the first voltage; and the second direction is at a preset angle from the first direction.

19. The display device of claim 18, wherein the Micro-LED display panel further comprises a plurality of second connection lines arranged in parallel, wherein the second connection lines each extend along the first direction;

two ends of each of the second connection lines are electrically coupled with the first voltage-main-line;

the plurality of second connection lines and the plurality of first connection lines cooperatively form a power grid comprising a plurality of grid units; and a first voltage-access-end of each of the pixel units is electrically coupled with a corresponding grid unit, to be electrically coupled with the first voltage-main-line to receive the first voltage.

20. The display device of claim 11, wherein the first voltage-main-line is a drive-voltage line, the second voltage-main-line is a reference-voltage line, the first voltage is a drive voltage, and the second voltage is a reference voltage; or the first voltage-main-line is a reference-voltage line, the second voltage-main-line is a drive-voltage line, the first voltage is a reference voltage, and the second voltage is a drive voltage.

* * * * *